United States Patent [19]

Schildge, Jr.

[11] Patent Number: 4,802,314

[45] Date of Patent: Feb. 7, 1989

[54] CABLE-STAY ROOF FOR STADIUM OR ARENA AND METHOD OF CONSTRUCTION OF SAME

[76] Inventor: Adam T. Schildge, Jr., 899 Green St., San Francisco, Calif. 94133

[21] Appl. No.: 124,969

[22] Filed: Nov. 24, 1987

[51] Int. Cl.[4] ..... E04H 3/12

[52] U.S. Cl. ..... 52/6; 52/60; 52/73; 52/83; 52/90; 52/745; 52/27

[58] Field of Search ..... 52/6, 73, 83, 747, 90, 52/167, 91, 168, 741, 745, 30, 27

[56] References Cited

U.S. PATENT DOCUMENTS

| | | | |
|---|---|---|---|
| 1,274,987 | 8/1918 | Carroll | 52/91 |
| 1,419,868 | 6/1922 | Levitan | 52/83 |
| 2,126,413 | 8/1938 | Respess | 52/83 |
| 2,881,718 | 4/1959 | Stromeyer | 52/83 |
| 3,477,183 | 11/1969 | Graham | 52/167 |
| 4,535,498 | 8/1985 | Webster | 14/20 |

FOREIGN PATENT DOCUMENTS

| | | | |
|---|---|---|---|
| 202879 | 6/1956 | Australia | 52/228 |
| 302005 | 11/1917 | Fed. Rep. of Germany | 52/83 |
| 1230062 | 12/1966 | Fed. Rep. of Germany | 14/18 |

OTHER PUBLICATIONS

The Cantilever Construction of Prestressed Concrete Bridges by Mathivat 1983, pp. 326, 327, TG/385/. M3.

Raum Liche Tragwerke Aug Stahl 1963, pp. 186, 187, 198, 199 TH/1611/M3.

*Primary Examiner*—John E. Murtagh

*Attorney, Agent, or Firm*—Limbach, Limbach & Sutton

[57] ABSTRACT

A roof structure and method of constructing the same wherein a large clear span is built over an existing or new athletic stadium or arena. The principal feature of the roof is that it is supported by Cable-Stays to towers standing outside the stadium and can be built over an existing stadium by cantilevering without entering the stadium, and places no added weight on the existing stadium. The structure includes a beam framework and a roof covering installed over the framework. The covering is fabricated of a clear skylight material to allow sufficient light transmission to permit a natural grass playing field, and it is openable to allow for ventilation.

26 Claims, 5 Drawing Sheets

CABLE-STAY ROOF FOR STADIUM OR ARENA AND METHOD OF CONSTRUCTION OF SAME

TECHNICAL

The invention relates to the structure and the method of construction of a large span steel or other material framed roof built over an athletic stadium or arena. The roof structure is supported by steel Cable-Stays to towers set outside the stadium and to ground anchors. The method of construction is a cantilevering method. The technology utilized is Cable-Stay Technology.

BACKGROUND OF THE INVENTION

The erection of structures utilizing suspension cables or Cable-Stay Technology has existed for some time. For example, many bridges utilize cables extending between towers or from a single tower to suspend a roadway. In addition, many buildings have been designed such that the roof structure is supported by cables. The principal advantage of utilizing cables to support a roof is that large covered buildings can be designed without any internal supports; and quite economically. One example of a structure which benefits from this type of design is an airplane hanger which requires a large area without pillars to permit positioning aircraft. Sporting arenas also benefit from this design since the design provides for unobstructed viewing.

Examples of roof structures designed by the applicant with Cable-Stay Technology can be found in the following U.S. Pat. design Nos. design D260,036, issued July 28, 1981; D270,570, issued Sept. 13, 1983; D 274,841, issued July 24, 1984; D274,842, issued July 24, 1984; D274,843, issued July 24, 1984, and in current utility U.S. Pat. No. 4,651,496 issued Mar. 24, 1987.

The design patents above relate to the ornamental appearance of Cable-Stay supported structures.

The utility patent above relates to a method of construction of a Cable-Stay roof over an existing or new stadium or arena and its design.

Also made reference to is pending design patent application filed May 8, 1987 under Ser. No. 047,064, which covers the ornamental appearance of the Cable-Stay supported structure utility patent applied for herein.

The invention of this application relates to the construction of a Cable-Stay roof over an existing or new stadium or arena, or other structure, and to the method of its construction Recently there has been significant amount of interest in covering existing as well as new open air athletic stadiums. As can be appreciated, many stadiums are located in areas where weather conditions make it difficult to hold events whenever desired or certain weather conditions can be simply objectionable.

Existing open air stadiums are generally not designed to support the weight of a newly added roof. Thus, in order to build a roof over an existing stadium, significant measures have to be taken to reinforce the stadium walls or build an additional support system. The latter steps, even if possible, can be difficult and expensive. With new stadiums this can be less of a problem.

There has been significant interest in making these roofs retractable or at least open for ventilation.

Also there has been interest in providing means of retaining a natural grass playing field on the stadium floor both in existing stadiums as well as in new stadiums.

Accordingly, it is an object of the subject invention to provide a new and improved method for constructing such a roof over an existing or new stadium or arena, or other structure.

It is an object of this invention to provide a means of constructing a roof over an existing or new stadium or arena that is both functional and cost effective to build.

It is an object of this invention to provide a new and improved method for constructing a cable supported roof which does not place any additional weight on the existing stadium.

It is an object of this invention to provide a new and improved method of constructing a cable roof structure over an existing or new stadium or arena which will provide unobstructed viewing within the stadium.

It is still another object of the subject invention to provide a new and improved method of constructing a cable roof structure over an existing or new stadium or arena which is capable of supporting a glass or a clear plastic roof cover to allow sufficient light transmission for the retention or use of a natural grass cover on the playing field, and to provide as well for the public enjoyment by creating an outdoor atmosphere.

It is also another object of the subject invention to provide a new and improved method of constructing a cable roof structure over an existing or new stadium or arena which is capable of supporting a partially retractable cover or one that opens sufficiently for ventilation.

It is further the object of this invention to provide a roof that allows for natural ventilation by keeping parts permanently open such that costly heating and air handling equiment might not be necessary.

It is further the object of this invention to provide a clear skylight roof cover such that costly additional lighting is not necessary in an existing stadium where tower lighting exists and can project through the skylight roof.

It is also the object of this invention to provide a roof that could support a restaurant and/or sightseeing walkways on its surface.

It is also the object of this invention to provide a roof that could support luxury private seating boxes suspended from the roof structure.

It is also the object of this invention to provide a roof for an existing stadium that can be built without entering the stadium so the stadium can be used during the construction period.

It is also the object of this invention to provide a roof that is structurally sound to withstand, besides its own weight and design loading, also high earthquake forces and unusual wind forces, and snow loading.

It is also the object of this invention to provide a roof that is relatively economical to build.

It is also the object of this invention to provide a roof that can be built by available technology and contractor's experience, as available in the marketplace at present.

It is also the object of this invention to provide a roof that is permanent and has a long life.

It is also the object of this invention to provide a roof that has relatively low operating and maintenance costs.

It is also the object of this invention to provide a roof that is beautiful.

SUMMARY OF INVENTION

In accordance with these and many other objects, the subject invention provides a structural design and a method of constructing such a roof over an existing or new stadium. The illustrated embodiment corresponds to the ornamental design shown in U.S. Patent application filed May 8, 1987 under Ser. No. 047,064.

The structural design is a roof of clear span suspended over the stadium and supported by Cable-Stays to towers outside the stadium and to ground anchors. The roof cover is either clear plastic or glass but could be of other material and is made partially retractable or openable for ventilation. The roof is outfitted with permanent ventilation louvers where needed and made to overlap the stadium rim it covers allowing a gap between the roof and the stadium rim for ventilation and overlapping in such a way that it also provides partial protection to concourse and other areas around the stadium.

The assembly of the roof structure is accomplished by first constructing two rows of parallel or curved towers on opposite sides of the stadium and tangent to the stadium, and then extending Cable-Stays from the towers to ground anchors outside the stadium. Cable-Stays are then extended from these towers and slanted into the stadium area to support roof long-beam framing, cantilevered from each tower and held back in compression thereagainst. Intermediate roof framing is then installed between the long-beam framing. The intermediate framing may take any of a number of forms. As an example, it may be open web steel joists or it may be a space frame or it may be box steel framing, the preferred method, or another framing system. The construction can be from one side of the stadium and then from the other or from both sides simultaneously. At the junction of the cantilevered sections in the middle of the span the two sections are connected to allow slip movement for temperature expansion and contraction and for other structural movements and are tensioned together b cables to control the horizontal force of the long-beams on legs of the tower. In this manner a stable roof framing is constructed across the stadium from both sides. The roof framing is therewith complete, left free to press against the tower legs and gain its support from Cable-Stays to the towers and in turn to ground anchors.

In practice, the roof members are lifted onto the roof by a ground crane and cables attached to the long-beam framing members are then connected to the towers by the top crane. As the roof extends out over the stadium a travelling derrick crane and a temporary rail mounted transport carriage, move material from the ground crane to the derrick crane. After the completed roof framing is in place, a roof cover of either glass or clear plastic skylight material or other material is installed over the framing. This is also lifted onto the roof by the ground crane at the edge of the roof and then manually or otherwise handled to the place of installation, or it may be installed by helicopter.

The cantilever method may be practiced without entering the interior of the existing stadium and it is conceivable that the stadium may be used during the construction period. The resulting roof has the following features:

Sections of the roof are made retractable by sliding sections over other sections on rails and controlling the operation remotely.

Retractability or ventilation may also be achieved by remotely controlled hinged door type openings, the preferred method, or any other means.

Lighting towers if present are left in place and existing lighting continues to illuminate the stadium by simply projecting through the clear skylight roof. Additional lighting where needed is added as well on the underside of the roof.

A grass playing field if present is retained.

The roof is made to overlap the existing or new stadium for ventilation and for partial protection of surrounding concourse areas.

The roof is provided with ventilation louvers as needed.

Elevators in the towers are provided for access to the roof and tower tops.

Walkways with cable handrails on the roof beams are constructed for maintenance and sightseeing.

A restaurant is built on the roof as desired.

Luxury private seating boxes are built suspended from the roof where desired.

High pressure water jets are installed on the roof for roof cleaning.

Where desired to completely close the roof to the stadium a flexible gasket is attached between the roof and the stadium rim.

BRIEF DESCRIPTION OF THE DRAWINGS

Further objects and advantages will become apparent from the foll iled description taken in conjunction with the drawings in which.

REFERENCE NUMBERS

Figures 1, 2:
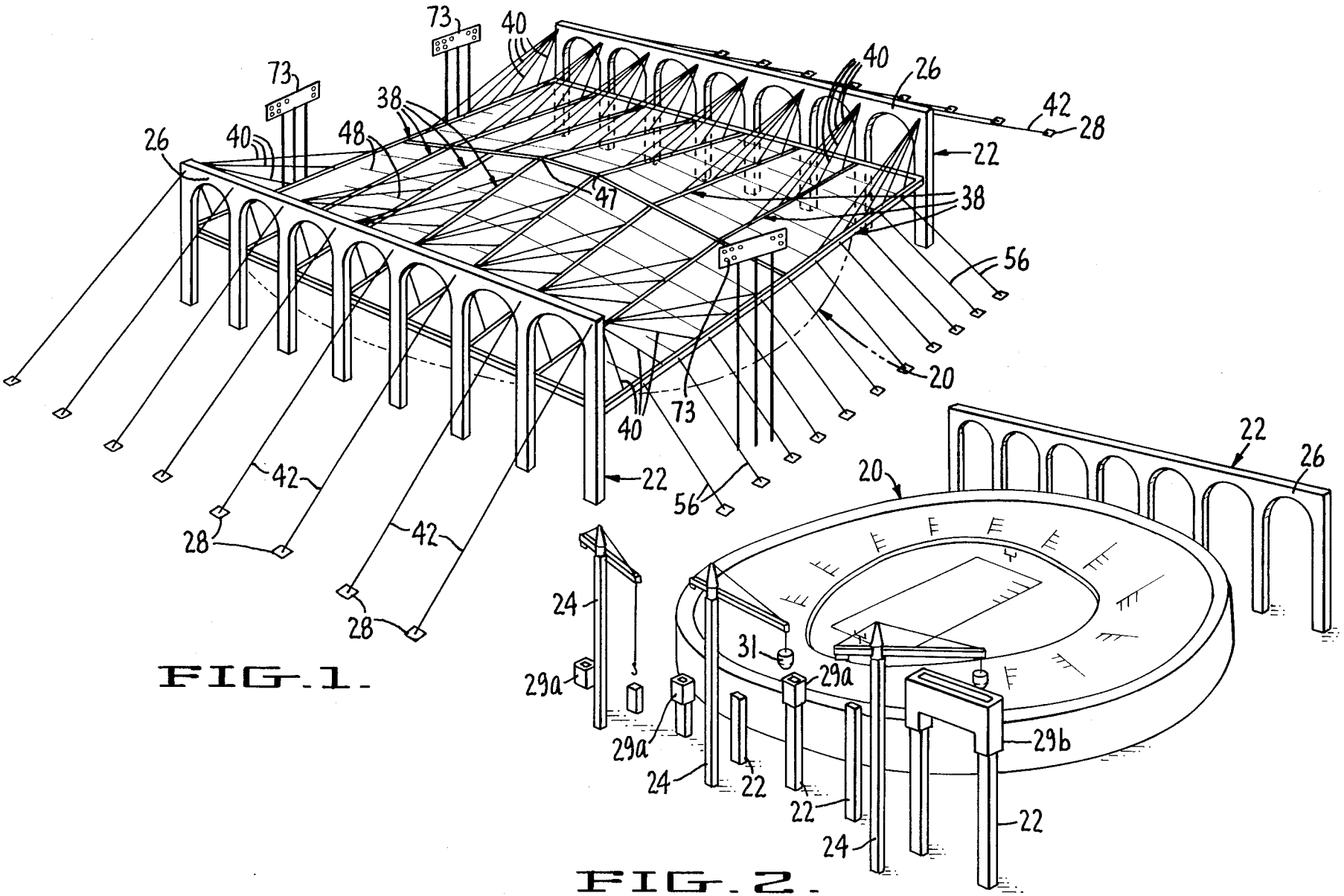
FIG. 1 is a perspective view of the Cable-Stay roof as set existing or new stadium or arena.
FIG. 2 is a perspective view of the support towers under construction set alongside the existing or new stadium or arena to be covered.

16 piles
18 foundations
20 stadium
22 towers
24 tower cranes
26 arches
28 ground anchors
**29*a*** slip form
**29*b*** slip form
30 ground crane
31 bucket
32 derrick crane
34 top crane
36 site where roof framing is assembled for lifting to the roof
38 roof long-beam framing
**38*a*** initial long beam framing member
40 Cable-Stays to roof framing
42 Cable-Stays to anchors or back-stays
44 transport carriage
46 point on the roof where opposite long-beams meet at center of span
47 peak
48 intermediate roof framing member
49 sleeve
50 roof covering, preferably a clear skylight
**50*a*** slidable roof sections
51 cable
52 point where roof long-beam framing meets towers
53 turnbuckle
54 cross-cables or struts for cable vibration dampening and enhanced structural stiffness as well as vibration noise control
56 hold-down cables at roof edge providing also partial lateral sidesway support
57 bolts
58 suspended luxury boxes for private seating
60 roof restaurant
62 water jets for roof cleaning
72 flexible closure gasket between stadium rim and roof
73 stanchion lighting
76 a boatswains chair or basket for access to cables for maintenance
78 a typical hinged type clear plastic roof bubble openable for ventilation
79 hydraulic cylinders
80 tower elevator

DETAILED DESCRIPTION OF THE PREFERRED EMBODIMENT

Turning first to FIG. 1, the basic elements of the Cable-Stay roof structure of the subject invention will be briefly discussed. The Cable-Stay roof structure is intended to cover an existing or new open air stadium or arena shown generally by the numeral 20. The Cable-Stay roof structure comprises two rows of towers 22 set in parallel rows on opposite sides of the stadium 20. The towers in each row are connected by arches 26 and rest on foundations 18 and, when needed, piles 16. The roof structure long-beam framing 38 is suspended by Cable-Stays 40 from the towers 22 and or their arches 26. This structure is further supported by back-stays 42 to ground anchors 28. Between the long-beam roof framing 38 is intermediate roof framing 48. Over the roof structure 38 and 48 is a roof covering or membrane 50 (see FIGS. 13 and 15) made of glass or of clear plastic or any other material and in desired areas the roof cover is made partially retractable or openable for ventilation and with louvered vents where needed and with permanently open parts where needed.

Having identified the main elements of the Cable-Stay roof structure, the preferred method of assembling this structure over an existing or new stadium or arena will be described in detail.

Figure 3:
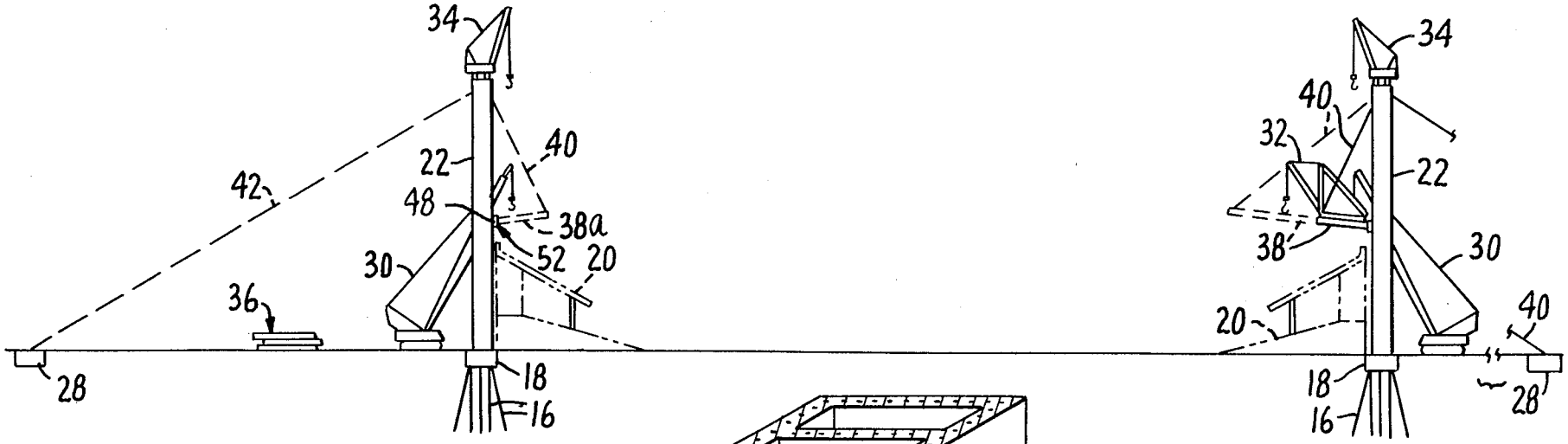
FIG. 3 is a diagrammatic elevational view showing the roof support towers and the initial sequence of the roof constructoon over a stadium by the cantilever method.

Starting with the stadium 20 in FIGS. 2 and 3, foundations 18, and piles 16 if needed are constructed exterior to the stadium 20. Over these foundations are constructed concrete or steel towers 22 with the use of tower cranes 24. The preferred embodiment has these towers as shown constructed from slip formed concrete in two parallel rows on opposite sides of the stadium. As an alternate they may be constructed in two curved planes on opposite sides of the stadium to more nearly fit to the shape of the stadium or they may be set in a circle, an ellipse, or other curved shape around the stadium or other structure. The preferred embodiment would have these tower rows at one point tangent to the stadium but they need not necessarily be tangent and can I5 be set off from the stadium. The towers 22 are then connected at their top by arches 26 to one another for strength. The form of the connection need not necessarily take the form of an arch and could be a lintel, a truss, an angular brace, or any other form of reinforcement; and futhermore this entire connection can also be entirely left out such that the remaining structure of towers resemble simply rows of singular standing towers unconnected at their tops or free standing. Furthermore the towers need not necessarily be vertical, but could be tilted outward or even inward to the stadium for structural or architectural reasons. The slip forms as illustrated in FIG. 2 are designated by the numerals 29*a* and 29*b* and are shown as being filled with concrete by buckets 31 carried by the cranes 24.

Once the towers 22 are constructed the roof construction can begin. Although the illustrated embodiment shows roof construction commencing after both rows of towers have been completed, construction can begin after one row of towers is constructed on one side of the stadium. It follows from the drawings that the roof is then constructed inward from these towers by a cantilevered method, either from one side at a time or from both sides simultaneously. All material is brought onto the roof and then installed by cantilevering out. By this method no entry to the stadium is necessary and the stadium can be operated during the time period of construction. Should it not be necessary to keep the stadium clear during construction as on a new stadium, material of the roof structure may be raised to the roof from the stadium floor rather than from outside and then installed by the cantilever method.

At the same time as the tower construction is commencing, the ground anchors 28 which would be generally of steel, concrete, and pile construction are also constructed. Upon completion of the towers, either before or simultaneously with the commencement of roof construction (as hereinafter described) back stay cables 42 are placed.

Following these assemblages, the roof construction itself may now proceed as follows. Prefabricated roof material, generally of steel but also if desired of wood or of concrete or even of other structural material is assembled on the site at 36. Ground crane 30, FIG. 3, then hoists an initial roof long-beam framing member 38*a*, FIG. 3, into position by hoisting it over the stadium rim between the towers and under the arches to a point on the roof and attaches one end of the framing member to a tower leg where it is connected at 52 (see FIG. 5). Connection is made by an intermediate roof framing member 48 fixed to the member 38*a* and bolted to the tower 22 by bolts 57. Attached to the other end of the framing member 38*a* is a cable 40 which is now pulled to the top of the tower by top crane 34 where it is tensioned by hydraulic jacks and connected to the tower. The cable 40 is of prescribed length and fitted with anchor sockets at both ends. By the use of prefabricated length cables, cables can be later exchanged if needed in the event of damage or corrosion. Such cables may be of the fully galvanized locked-wire type and installed with sufficient tension to provide a tight seal against water intrusion and in turn corrosion or they may be protected by a cover for corrosion protection or they may be of other construction. To install and make tight such cables, a typical end socket is fitted with an extension rod screwed into the end of the cable socket. The cable and rod then can be pulled into place by a winch or pulley and by the top crane 34 allowing sufficient sag so that the force to pull the cable and rod can be reasonably handled. Once in place with the cable rod extension in a hydraulic press mounted in the tower, the rod extension is then pulled by the hydraulic press or jack to the very high tension and low sag of the final cable configuration and the cable socket is then firmly anchored in the cable anchorage and the rod extension removed. Shims can then be installed at the socket anchorage to make minor adjustment and the connection of the socket to the structure can also be adjusted by a threaded nut attached to the outside of the socket to which the connection of the cable to its anchorage is made. In such a manner then the first long-beam framing member is installed and connected to the tower by its Cable-Stay. The cable referred to may be one cable or a multiple of cables grouped together. The aforedescribed tensioning and anchorage structure is well known and not unique to the present invention. Accordingly, it has not been illustrated.

Thereafter a back-stay cable 42 is installed in like manor between the anchorage and the tower. The back-stay cables as well may be singular cables or multiple cables. All cables are of fixed length with sockets at both ends. The cables may be sloped at the angle shown or may be sloped at a steeper angle so that the anchors are closer to the stadium. The back-stay cables may also be sloped at a flatter angle placing the anchors at a further distance from the stadium than shown. The preferred angle, however, is one that permits the load these cables exert onto the towers to be a vertical load rather than an angular load which imposes a bending force into the tower. The cables can be attached first at either the tower or at the anchorage and then pulled into place at the opposite end by the method described above. The cables can be supported on a temporary falsework or scaffolding or a suspended cable construction footwalk for their erection, or they can be installed without these measures.

The cables, as stated, can be either singular or multiple cables. Where they are multiple cables they are connected together at intermediate points. A boatswains chair or basket suspended from the cables may be used for access to perform this operation. See 76 in FIG. 10.

The cables after they are installed receive a final coat of paint. A boatswains chair may be used again which may also later be used for repainting and inspection.

Other types of cables other than described may also be used, and the method of installation may vary, but the end configuration is not changed.

For an example the cables might be fabricated to be continuous over the towers supported on saddle supports in the towers and then connected at one end to a long-beam framing member 38 and the other end to a ground anchorage 28 and then tensioned at one or the other end.

For another example, the tensioning of the cables may be made by jacking the cable support in the tower upward either in addition to the tensioning made at the ends of the cables or entirely in this manner.

After all cables are installed the cables may be connected between Cable-Stays by other cross-cables 54 or by struts 54 to dampen any wind induced or earthquake induced vibrations which could develop. (See FIG. 12.) This also increases the general stiffness of the roof and can help to control vibration noises. Vibration dampers consisting of shock absorbers or rubber ring dampers may also be installed at the cable connection points.

Figure 8:
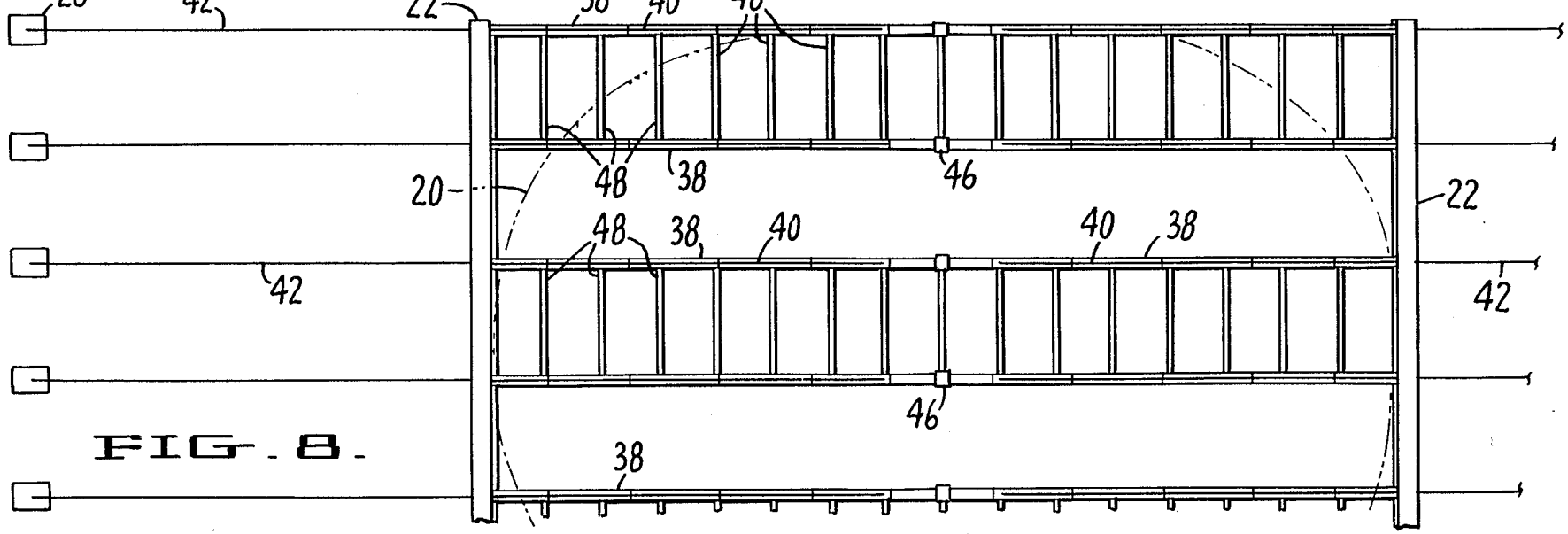
FIG. 8 is a plan view of an intermediate first stage of roof construction, showing every other roof section constructed.

Now after the initial long-beam framing member 38*a* is installed as described to this point, FIG. 3, a second is installed in like manner from the next adjacent tower leg and intermediate framing 48 is installed, as seen in FIG. 8, by being secured between the long beam frame members 38. The intermediate framing 48 may be of many different types. It may be open web steel joists, a space frame, or tubular steel joists, or any other framing system. A tubular steel or aluminum framing system, the preferred method, is shown in the drawings for the intermediate framing. The intermediate roof framing 48 by definition is all framing located between the roof long-beam framing members 38.

The next step is for the ground crane 30 to lift and put in place the stiff-leg derrick crane 32 on the cantilevered roof section constructed and to also put up the temporary rail mounted transport carriage 44 on the roof which is used to haul material from where it is lifted on to the roof out to the cantileverd end for installation by the derrick crane 32. (See FIGS. 3, 4 and 6.)

Futhermore a safety net is now installed to extend under all cantilever construction.

Figure 4:
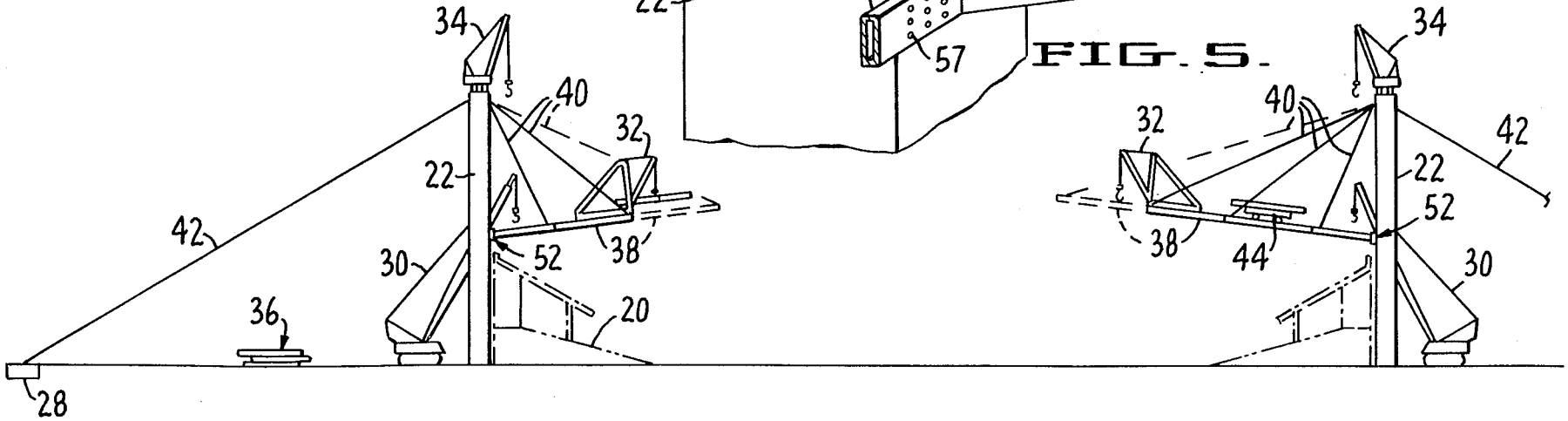
FIG. 4 is a diagrammatic elevational view similar to FIG. 3, additionally showing a transport carriage on the roof and the next sequential step in the cantilever construction method.

The roof construction now proceeds in similar fashion as by the initial framing member installation described above, but with the additional use now of the derrick crane 32 and the transport carriage 44. The procedure which repeats itself until one cantilevered section is built out to the middle of the stadium is as follows. Referring to FIG. 4, the ground crane 30 hoists roof framing members 38 and 48 from location 36 onto the roof between the towers and under the arches. The material is then loaded onto the temporary rail mounted transport carriage and carried out to the cantilevered end where it is installed by the derrick crane 32 onto the cantilevered end of the next preceding framing members. The Cable-Stays 40 and back-stays 42 are then installed as described above by top crane 34. In this manner the roof is successively built out over the stadium. Alternate sections which might be 90 feet in width are built first so that the constructed unit hangs evenly. A completed cantilevered section, one half the span of the stadium, may be 425' in length. After the alternate sections are so constructed, FIG. 8, the derrick crane is mounted in the open sections between the alternate sections, and intermediate the framing 48 installed in these intermediate sections to finish the roof, FIG. 9. In each case after a roof section is constructed the temporary rail mounted transport carriage and the derrick crane is driven back to the edge of the roof at the towers and removed from the roof by the ground crane 30 to be reinstalled in the next section to be constructed.

The roof is constructed as above from two sides of the stadium and joined in the middle. It is built either from both sides simultaneously or one side at a time.

Figure 16:
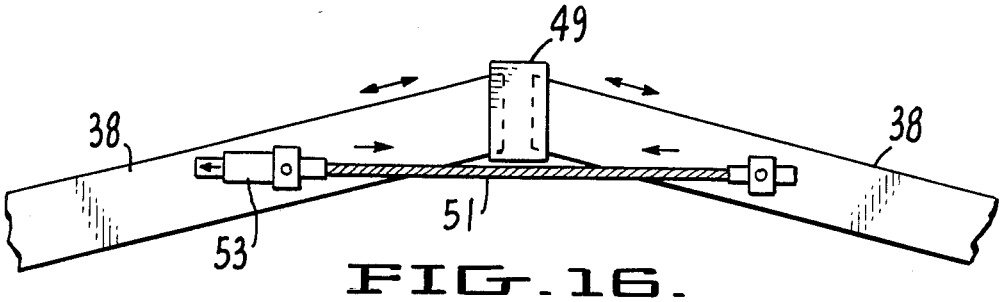
FIG. 16 shows the slip joint or flexible joint where the roof long-beam framing members meet at the center of the roof providing for structural movement due to temperature and other causes and allowing tensioning with a flexible cable connection.

The next step is the joining in the middle of the long-beams provided by the framing members 38. This is done in such a manner to allow for future movement of the long-beams due to temperature changes and other causes. The connecting structure is shown in FIG. 16 and comprises a slip joint provided by a sleeve 49 between the opposed cantilevered long beams and a tension cable 51 secured between the beams. A turnbuckle 53 provides for select adjustment of the tension on cable 51 and control of the long-beam force exerted on the tower legs at the edge of the roof.

Now hold-down and sidesway cables 56 are installed as needed between the roof edge and the ground or stadium structure. From FIG. 1 it will be seen that the long beams 38 and the resultant roof sections slope upwards from the towers to the point where they join and that the roof also slopes laterally from the center peak designated 47. The outermost beams 38 to which the cables 58 are joined are essentially horizontal.

After the entire roof framing is installed, checked, and adjusted, and painted, the roof covering 50 and the retractable or openable roof elements and louvered sections are installed. This is accomplished either by hoisting the materials of the roof cover onto the roof edge by the ground crane 30 and then moving them into place; or by lowering the materials onto the roof by helicopter. The retractable or openable sections are also lifted into place in the same manner and installed.

The roof is made retractable by allowing any number of roof sections, either contiguous or spaced, to slide over other roof sections and to be controlled either manually or by remote means. Such sections are designated **50*a* in FIG. 13. The remote control opening mechanism may be a hydraulic ram system to open and close the roof or it may be a mechanical cable controlled system. Retractability or ventilation opening may also be achieved by a hinged door type opening also remotely controlled. Such openings may be seen in FIGS. 14 and 15 wherein bubble panels 78 are hinged at one edge to framing 48 and may be selectively engaged or raised from engagement with adjacent framing by hydraulic cylinders 79. The roof cover 50** may also be made with louvers to allow for ventilation and, if desired, portions of the roof cover may be made permanently open in certain areas.

The roof as so constructed overlaps the stadium rim in such a manner that no rain and only minor amounts of wind can enter, but ventilation can occur. (See FIG. 9.) The roof is left unconnected to the stadium to allow for independent structural movement. The roof overlaps the rim of the stadium to provide also some protection to the concourse and other areas around the stadium.

The space between the roof and the stadium rim is made of sufficient size, possibly 10', to allow for desired ventilation. The roof, however, may be connected at this point to the stadium if so desired and the space may be closed. The closure may be a flexible gasket. See 72 FIG. 10.

Stadium stanchion lighting 73 (see FIG. 1) where existing is left in place or, where interference with the roof tower assembly 22 and 26 occurs, remounted on the roof tower assembly. These lights can then project through the completed clear skylight roof illuminating the stadium interior. Additional lighting if necessary can be installed on the underside of the roof structure.

Additional details of construction include: roof drainage and downspouts (not illustrated); roof condensation gutters on the underside of the roof (not illustrated); high pressure water cleaning jets 62 on the roof for cleaning; elevators 80 installed in the towers for access to the top of the towers and the roof; walkways and handrails formed on the tower tops and on the roof beams 38 for maintenance and sightseeing; a restaurant 60 constructed on the roof (see FIGS. 9 and 10); and luxury boxes 58 for private seating built on the roof or suspended from the roof.

It is to be understood that while the subject invention has been described with reference to a preferred method of assembly, other variations could be made by one skilled in the art without varying from the scope and the spirit of the subject invention as defined by the appended claims.

I claim:

1. A methoid of contructing a roof over an existing stadium, said method comprising:

(a) erecting a first row of cable stay towers outside one side of the stadium;

(b) erecting a seocnd row of cable stay towers outside the side of the stadium opposite said one side;

(c) cantileering roof structure in compression imparting relaionship from each row of said towers by progressively extending sections of said structure from said towers and over the stadium while suspending each sucessive section by a cable stay connection to the tower from which the section extends; and, (d) joining the roof structures cantilivered from the rows of towers in tension to partially relieve compressive forces of the structures on the towers and limit such forces.

2. A method according to claim 1 further comprising extending cable-stays form the towers to anchors located outside of the stadium.

3. A method according to claim 1 wherein the structures are joined by a slip connection to permit the structures to move toward one another.

4. A method according to claim 1 wherein the towers in each row are joined by arches.

5. A method according to claim 1 further comprising extending lateral ties from the roof structures to anchors disposed outside of the stadium.

6. A method according to claim 1 further comprising extending a flexible weather seal from the roof structures to the stadium.

7. A method according to claim 1 wherein the sections of the roof structure are extended by first progressively extending long beam framing from the towers in generally parallel relationship to one another, then joining adjacent long beam framing by intermediate roof framing, and then securing a roof membrane between the long beam framing.

8. A method according to claim 7 further comprising providing means to open at least certain parts of the roof membrane.

9. A method according to claim 7 wherein the roof membrane is transparent.

10. A roof structure for use over an open topped stadium, said structure comprising:

(a) a first row of cable stay towers located outside one side of the stadium;

(b) a second row of cable stay towers located outside the stadium to the side thereof opposite said one side;

(c) a first roof section cantilevered from the first row of towers anad extending therefrom partially over the stadium and toward the second row of towers, said section being disposed in compression imparting relationship to the first row of towers;

(d) a second roof section cantilevered from the second row of towers and extending therefrom partially over the stadium and toward the first row of towers, said section being disposed in compression imparting relationship to the second row of towers;

(e) first cable stay means extending from each row of said towers to suspend the load of the roof section cantilevered therefrom;

(f) second cable stay means extending from each row of said towers to counterbalance the load imparted to the towers by the first cable stay means; and, (g) connecting means securing said roof sections together in tension to partially releive compressive forces imparted to the towers by said sections and limit such forces.

11. A structure according to claim 10 wherein said connecting means permit said roof sections to move toward one another without imparting destructive compressive forces to the towers.

12. A structure according to claim 11 wherein said connecting means further comprises a tie securing said roof sections against separation.

13. A structure according to claim 10 further comprising hold down means extending laterally from said roof sections to anchors disposed outside the stadium.

14. A structure according to claim 10 wherein said roof sections comprise:

(a) long beams extending from the towers and over the stadium in generally parallel relationship to one another;

(b) intermediate roof framing members secured to and extending between adjacent long beams; and, (c) a roof membrane at least partially closing the space between the long beams.

15. A structure according to claim 14 wherein said roof membrane comprises transparent panels, at least certain of which may be opened for ventilation.

16. A structure according to claim 15 wherein said certain panels extend between adjacent pairs of intermediate roof framing members and are hinged to one intermediate roof framing member of each pair and elevatable relative to the other member of the pair.

17. A structure according to claim 10 wherein said roof sections slope upwardly from the towers and are connected at a peak disposed over the stadium.

18. A structure according to claim 17 wherein the roof sections slope downwardly from the peak laterally from a point disposed generally centrally of the connected roof sections.

19. A structure according to claim 10 wherein the roof sections are disposed in spaced relationship to the periphery of the stadium whereby no load forces are imparted to the stadium by the structure.

20. A structure according to claim 19 further comprising a resilient seal disposed between the roof sections and the periphery of the stadium.

21. A structure according to claim 10 further comprising arches joining the towers in each row of towers.

22. A structure according to claim 10 further comprising sightseeing ands maintaenance walkways on the roof framing members.

23. A method of constructing a roof over an existing stadium, said method comprising:

(a) erecting a first row of cable stay towres outside one side of the stadium;

(b) erecting a secodn row of cable stay towers outside the side of the stadium opposite said one side;

(c) cantilevering roof structure from each row of said towers by progressively extending sections of said structure from said towers and over the stadium while suspending each successive section by a cable stay connection to the tower from which the section extends by the following steps:

(i) preconstrcuting and disposing the roof sections at staging areas located at the foot of the towers;

(ii) lifting the sections onto the towers by ground located cranes;

(iii) initially suspendigg the sections in cantilevered relationship to the towers by tower located cranes; and, (iv) sucessively placing the sections in cantlivered relationship by traveling derrick cranes movable long the roof structure;

(d) joining the roof structures cantilevered from the rows of towers to provide a cover over the stadium.

24. A roof structure for use over a pre-existing open topped stadium, said structure comprising:

(a) a first row of cable stay towers located outside one side of the stadium;

(b) a second row of cable stay towers located outside the stadium to the side thereof opposite saids one side;

(c) a first roof section cantilevered from the first row of towers and extending therefrom aprtialy over the stadium and toward the second row of towers, said section being dispersed in compression imparting relationship to the first row of towers;

(d) a second roof section cantilevered from the second row of towers and extending therefrom partially over the stadium and toward the first row of towers, said section being disposed in compression imparting relationship to the second row of towers;

(e) first cable stay means extending from each row of said towers to suspend the load of the roof section cantilevered therefrom;

(f) second cable stay means extending from each row of said towers to counterbalance the load imparted to the towers by the first cable stay means;

(g) connecting means securing said roof sections together; and, (h) occupant carrying compartments supported on the roof sections.

25. A roof structure for use over a pre-existing open topped stadium, said structure comprising:

(a) a first row of cable stay towers located outside one side of the stadium;

(b) a second row of cable stay towers located outside the stadium to the side thereof opposite said one side;

(c) a first roof section cantilvered from the first row of towers and extending therefrom partially over the stadium and toward the second row of towers, said section being disposed in compression imparting relationship to the first row towers;

(d) a second roof section cantilevered from the second row of towers and extending therefrom partially over the stadium and toward the first row of towers, said section being disposed in compression imparting relationship to the second row of towers;

(e) first cable stay means extending from each row of said towers to suspend the load of the roof section cantilevered therefrom;

(f) second cable stay means extending from each row of said towes to counterbalance the load imparted to the towers by the first cable stay means;

(g) connecting means securing said roof sections together; and, (h) water jets carried by and above the roof secitons for dispensing water over the sections.

26. A roof structure for use over a pre-existing open topped stadium, said structure comprising:

(a) a first row of cable stay towers located outside one side of te stadium;

(b) a second row of cable stay towers located outside the stadium to the side thereof opposite said one side;

(c) a first roof section cantilevered from the first row of towers and extending therefrom partially over the stadium and toward the second row of towers, said section being disposed in compression imparting relationship to the first row of towers;

(d) a second roof section cantilevered from the second row of towers and extending therefrom partially over the stadium and toward the first row of towers, said section being disposed in compression imparting relationship to the second row of towers;

(e) first cable stay means extending from each row of said towers to suspend the load of the roof section cantilevered therefrom;

(f) second cable stay means extending from each row of said towers to counterbalance the load imparted to the towers by the first cable stay means;

(g) connecting means securing said roof sections together; and, (h) elevators in the towers for roof and tower access.

* * * * *

UNITED STATES PATENT AND TRADEMARK OFFICE

CERTIFICATE OF CORRECTION

PATENT NO. : 4,802,314

DATED : February 7, 1989

INVENTOR(S) : Schildge, Jr.

It is certified that error appears in the above-identified patent and that said Letters Patent is hereby corrected as shown below:

Columns 3, 4, 5, 6, 9, 10, 11, 12, 13 and 14 should be deleted to appear as per attached columns.

Signed and Sealed this

Sixteenth Day of May, 1989

*Attest:*

DONALD J. QUIGG

*Attesting Officer*

*Commissioner of Patents and Trademarks*

SUMMARY OF INVENTION

In accordance with these and many other objects, the subject invention provides a structural design and a method of constructing such a roof over an existing or new stadium. The illustrated embodiment corresponds to the ornamental design shown in U.S. Patent application filed May 8, 1987 under Ser. No. 047,064.

The structural design is a roof of clear span suspended over the stadium and supported by Cable-Stays to towers outside the stadium and to ground anchors. The roof cover is either clear plastic or glass but could be of other material and is made partially retractable or openable for ventilation. The roof is outfitted with permanent ventilation louvers where needed and made to overlap the stadium rim it covers allowing a gap between the roof and the stadium rim for ventilation and overlapping in such a way that it also provides partial protection to concourse and other areas around the stadium.

The assembly of the roof structure is accomplished by first constructing two rows of parallel or curved towers on opposite sides of the stadium and tangent to the stadium, and then extending Cable-Stays from the towers to ground anchors outside the stadium. Cable-Stays are then extended from these towers and slanted into the stadium area to support roof long-beam framing, cantilevered from each tower and held back in compression thereagainst. Intermediate roof framing is then installed between the long-beam framing. The intermediate framing may take any of a number of forms. As an example, it may be open web steel joists or it may be a space frame or it may be box steel framing, the preferred method, or another framing system. The construction can be from one side of the stadium and then from the other or from both sides simultaneously. At the junction of the cantilevered sections in the middle of the span the two sections are connected to allow slip movement for temperature expansion and contraction and for other structural movements and are tensioned together by cables to control the horizontal force of the long-beams on legs of the tower. In this manner a stable roof framing is constructed across the stadium from both sides. The roof framing is therewith complete, left free to press against the tower legs and gain its support from Cable-Stays to the towers and in turn to ground anchors.

In practice, the roof members are lifted onto the roof by a ground crane and cables attached to the long-beam framing members are then connected to the towers by the top crane. As the roof extends out over the stadium a travelling derrick crane and a temporary rail mounted transport carriage, move material from the ground crane to the derrick crane. After the completed roof framing is in place, a roof cover of either glass or clear plastic skylight material or other material is installed over the framing. This is also lifted onto the roof by the ground crane at the edge of the roof and then manually or otherwise handled to the place of installation, or it may be installed by helicopter.

The cantilever method may be practiced without entering the interior of the existing stadium and it is conceivable that the stadium may be used during the construction period. The resulting roof has the following features:

Sections of the roof are made retractable by sliding sections over other sections on rails and controlling the operation remotely.

Retractability or ventilation may also be achieved by remotely controlled hinged door type openings, the preferred method, or any other means.

Lighting towers if present are left in place and existing lighting continues to illuminate the stadium by simply projecting through the clear skylight roof. Additional lighting where needed is added as well on the underside of the roof.

A grass playing field if present is retained.

The roof is made to overlap the existing or new stadium for ventilation and for partial protection of surrounding concourse areas.

The roof is provided with ventilation louvers as needed.

Elevators in the towers are provided for access to the roof and tower tops.

Walkways with cable handrails on the roof beams are constructed for maintenance and sightseeing.

A restaurant is built on the roof as desired.

Luxury private seating boxes are built suspended from the roof where desired.

High pressure water jets are installed on the roof for roof cleaning.

Where desired to completely close the roof to the stadium a flexible gasket is attached between the roof and the stadium rim.

BRIEF DESCRIPTION OF THE DRAWINGS

Further objects and advantages will become apparent from the following detailed description taken in conjunction with the drawings in which:

FIG. 1 is a perspective view of the Cable-Stay roof as set over an existing or new stadium or arena.

FIG. 2 is a perspective view of the support towers under construction set alongside the existing or new stadium or arena to be covered.

FIG. 3 is a diagrammatic elevational view showing the roof support towers and the initial sequence of the roof construction over a stadium by the cantilever method.

FIG. 4 is a diagrammatic elevational view similar to FIG. 3, additionally showing a transport carriage on the roof and the next sequential step in the cantilever construction method.

Figure 5:
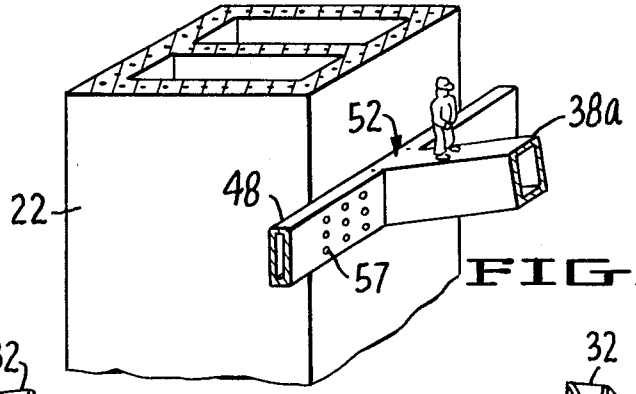
FIG. 5 is an enlarged perspective view, with parts broken a of a roof long-beam framing member where connection made to the tower leg.

FIG. 5 is an enlarged perspective view, with parts broken away, of a roof long-beam framing member where connection is made to the tower leg.

Figure 6:
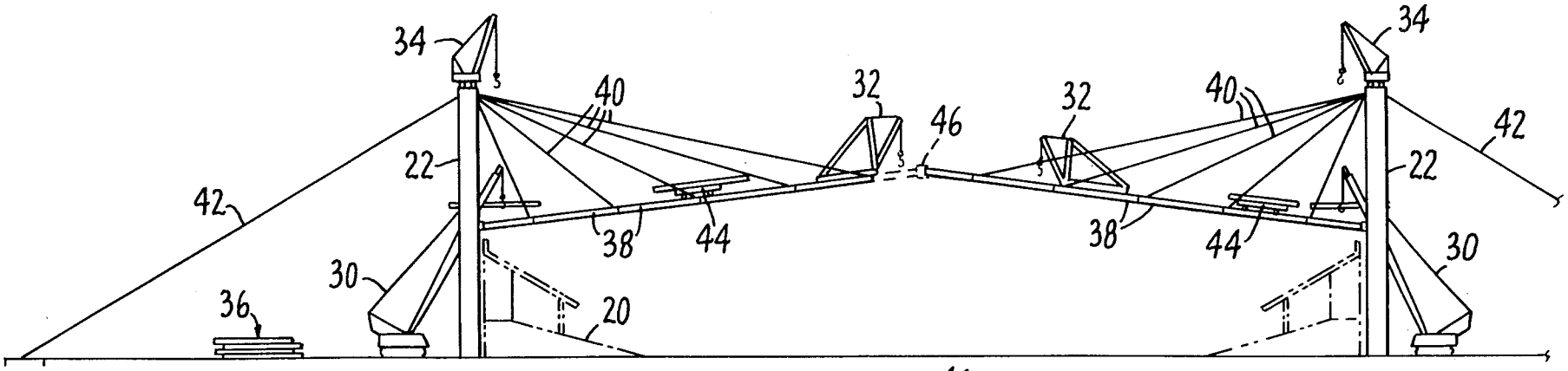
FIG. 6 is a diagrammatic elevational view similar to FIGS. 3 and 4, showing the existing or new stadium or arena and the completed tower assemblies and the roof framing now built out to the center of the roof and the final connection being made and tensioned.

FIG. 6 is a diagrammatic elevational view similar to FIGS. 3 and 4, showing the existing or new stadium or arena and the completed tower assemblies and the roof framing now built out to the center of the roof and the final connection being made and tensioned.

Figure 7:
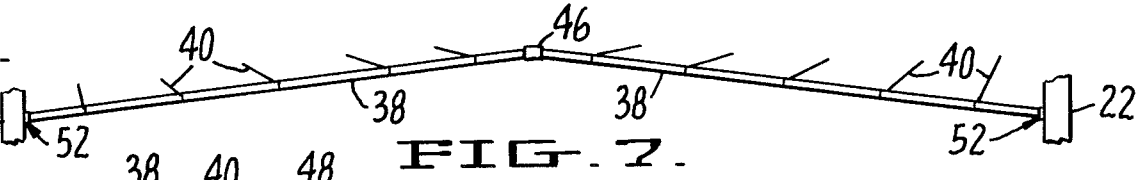
FIG. 7 is a diagrammatic elevational view, with parts broken away, showing the final roof with the framing with Cable Stays completed.

FIG. 7 is a diagrammatic elevational view, with parts broken away, showing the final roof with the framing with Cable Stays completed.

FIG. 8 is a plan view of an intermediate first stage of roof construction, showing every other roof section constructed.

Figure 9:
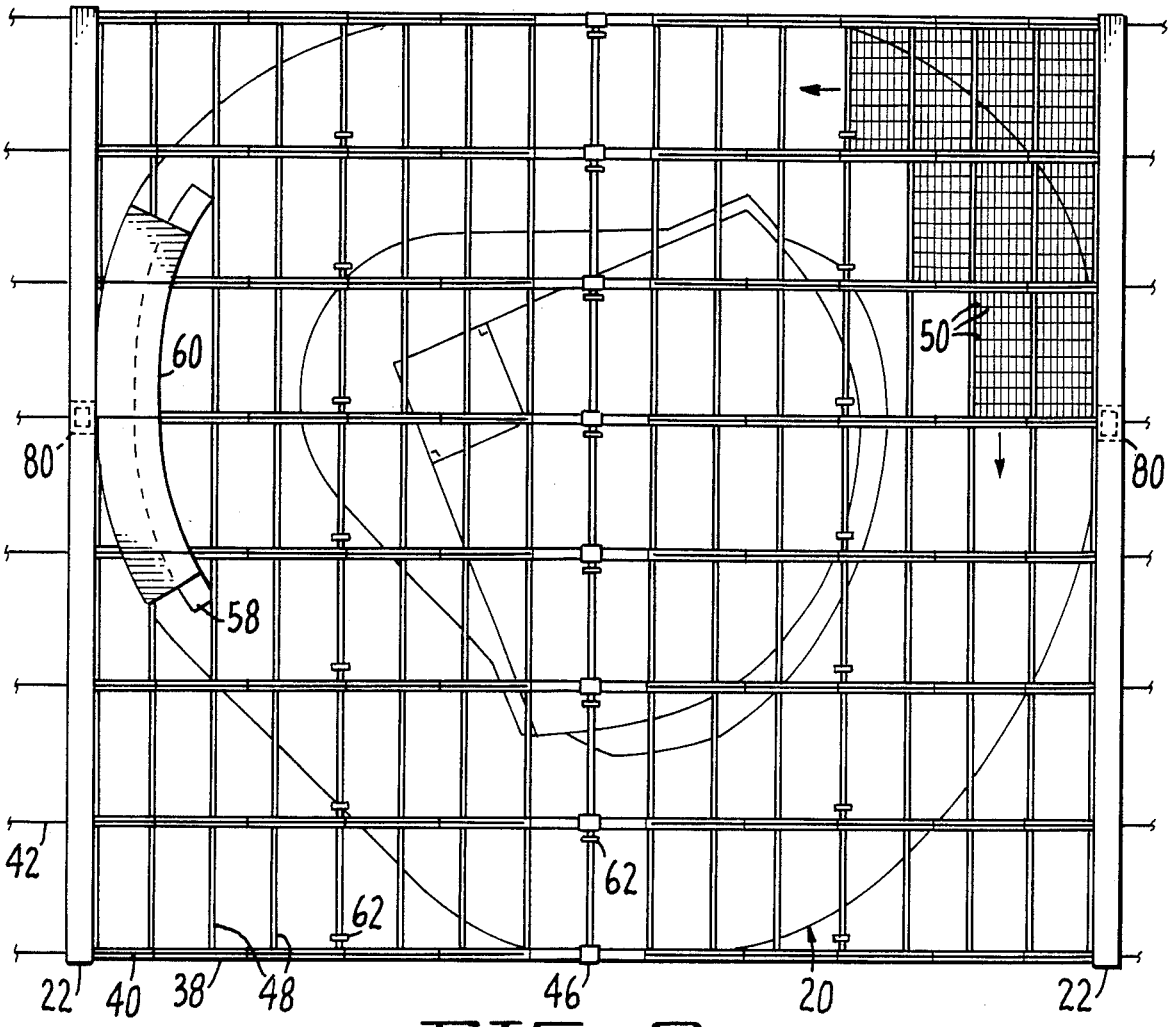
FIG. 9 is a plan view of the roof with all sections completed, including a roof restaurant, luxury seating boxes, water jets for cleaning, beam walkways, and different forms of roof retractability or partial opening.

FIG. 9 is a plan view of the roof with all sections completed, including a roof restaurant, luxury seating boxes, water jets for cleaning, beam walkways, and different forms of roof retractability or partial opening.

Figure 10:
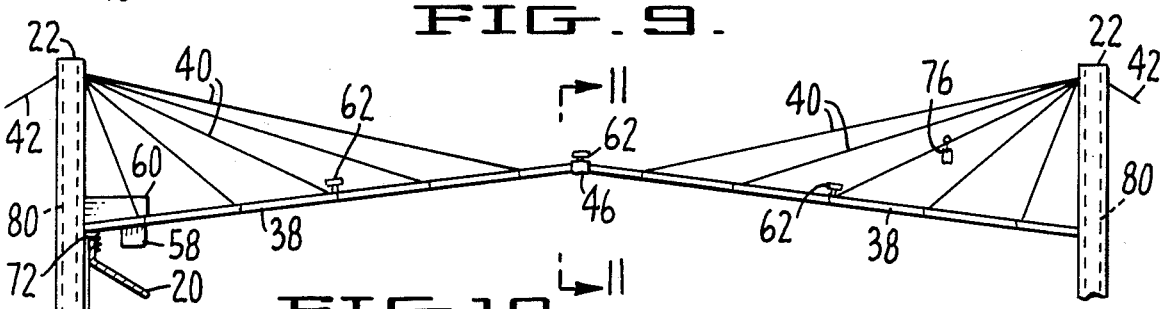
FIG. 10 is an elevational sectional view through the center of the roof showing water jets on the roof, a boatswains chair or basket on the cables for access, a roof restaurant, a flexible closure gasket between the roof edge and the stadium, and suspended luxury seating boxes.

FIG. 10 is an elevational sectional view through the center of the roof showing water jets on the roof, a boatswains chair or basket on the cables for access, a roof restaurant, a flexible closure gasket between the roof edge and the stadium, and suspended luxury seating boxes.

Figure 11:
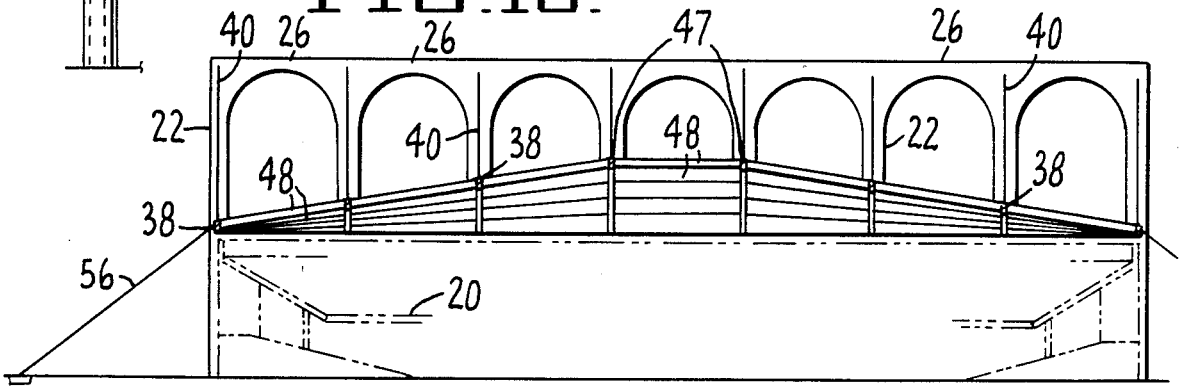
FIG. 11 a cross-sectional view taken on line 11—11 of FIG. 10, also showing hold down and sideways cables.

FIG. 11 a cross-sectional view taken on line 11—11 of FIG. 10, also showing hold down and sidesway cables.

Figure 12:
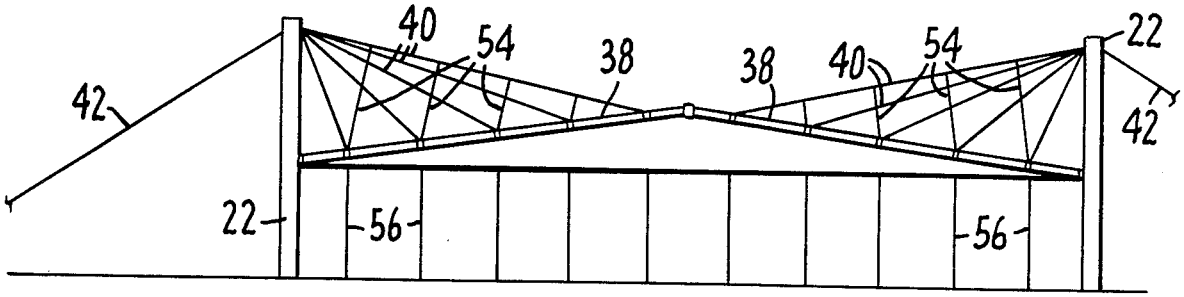
FIG. 12 is a view similar to FIG. 10, but also showing hold-down sidesway cables at the roof's edge. Also shown are cross-cables or struts between the Cable-Stays to limit wind structural vibration of the cables, to control cable vibration noise control, and to enhance roof stiffnes. These cables might not be needed.

FIG. 12 is a view similar to FIG. 10, but also showing hold-down sidesway cables at the roof's edge. Also shown are cross-cables or struts between the Cable-Stays to limit wind structural vibration of the cables, to control cable vibration noise control, and to enhance roof stiffness. These cables might not be needed.

Figure 13:
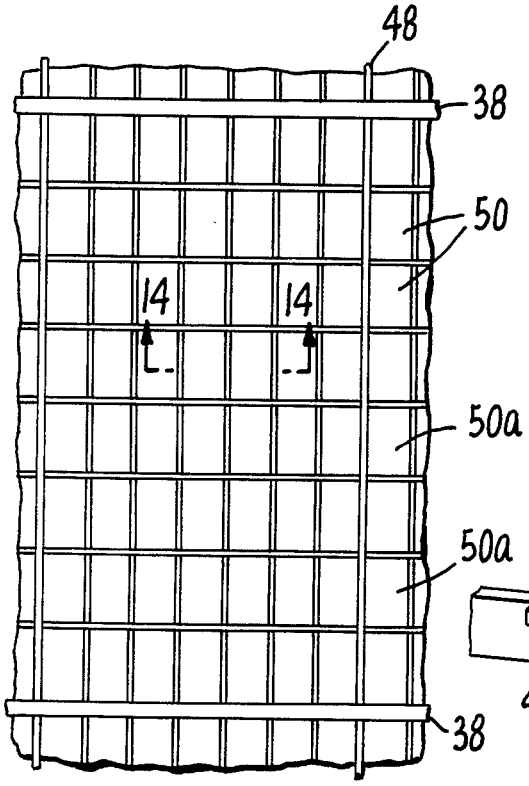
FIG. 13 is an expanded plan view of the intermediate framing between the long-beam framing members supporting the roof cover in the preferred method of using clear plastic bubble skylights approximately 7'-6" by 12' in dimension with each one operable by remote control for ventilation.

FIG. 13 is an expanded plan view of the intermediate framing between the long-beam framing members supporting the roof cover in the preferred method of using clear plastic bubble skylights approximately 7'-6" by 12' in dimension with each one operable by remote control for ventilation.

Figure 14:
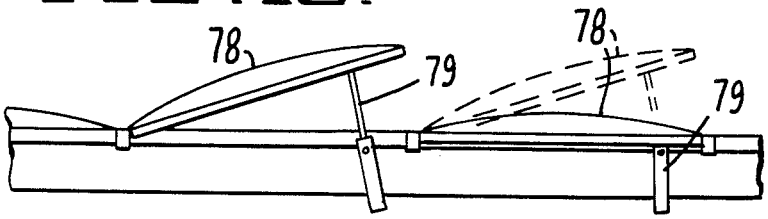
FIG. 14 is a cross-sectional view taken on line 14—14 of FIG. 13, showing the operable hinged method of opening of each skylight bubble by remote control.

FIG. 14 is a cross-sectional view taken on line 14—14 of FIG. 13, showing the operable hinged method of opening of each skylight bubble by remote control.

Figure 15:
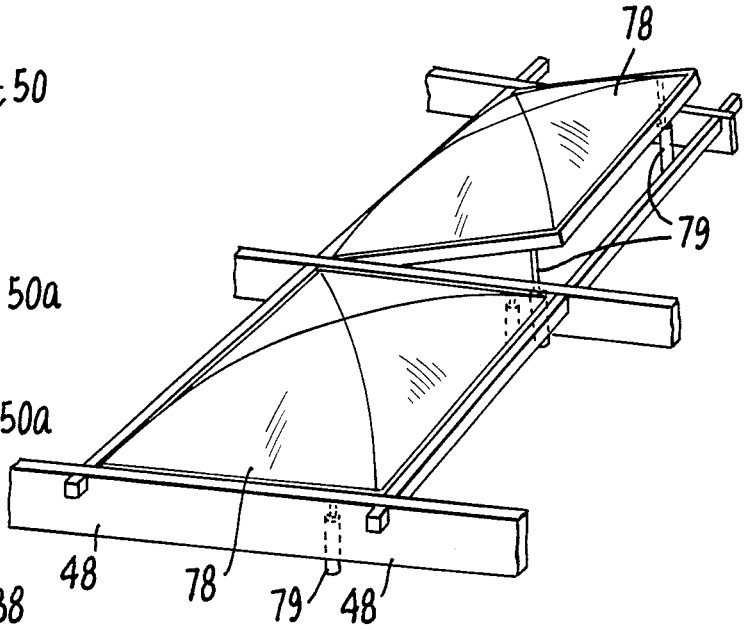
FIG. 15 is a perspective view of a typical skylight bubble and its hinged opening mode. On a large stadium there could be more than 6000 of these bubbles to make the entire roof.

FIG. 15 is a perspective view of a typical skylight bubble and its hinged opening mode. On a large stadium there could be more than 6000 of these bubbles to make the entire roof.

FIG. 16 shows the slip joint or flexible joint where the roof long-beam framing members meet at the center of the roof providing for structural movement due to temperature and other causes and allowing tensioning with a flexible cable connection.

REFERENCE NUMBERS

16 piles
18 foundations
20 stadium
22 towers
24 tower cranes
26 arches
28 ground anchors
**29*a*** slip form
**29*b*** slip form
30 ground crane
31 bucket
32 derrick crane
34 top crane
36 site where roof framing is assembled for lifting to the roof
38 roof long-beam framing
**38*a*** initial long beam framing member
40 Cable-Stays to roof framing
42 Cable-Stays to anchors or back-stays
44 transport carriage
46 point on the roof where opposite long-beams meet at center of span
47 peak
48 intermediate roof framing member
49 sleeve
50 roof covering, preferably a clear skylight
**50*a*** slidable roof sections
51 cable
52 point where roof long-beam framing meets towers
53 turnbuckle
54 cross-cables or struts for cable vibration dampening and enhanced structural stiffness as well as vibration noise control
56 hold-down cables at roof edge providing also partial lateral sidesway support
57 bolts
58 suspended luxury boxes for private seating
60 roof restaurant
62 water jets for roof cleaning
72 flexible closure gasket between stadium rim and roof

73 stanchion lighting
76 a boatswains chair or basket for access to cables for maintenance
78 a typical hinged type clear plastic roof bubble openable for ventilation
79 hydraulic cylinders
80 tower elevator

DETAILED DESCRIPTION OF THE PREFERRED EMBODIMENT

Turning first to FIG. 1, the basic elements of the Cable-Stay roof structure of the subject invention will be briefly discussed. The Cable-Stay roof structure is intended to cover an existing or new open air stadium or arena shown generally by the numeral 20. The Cable-Stay roof structure comprises two rows of towers 22 set in parallel rows on opposite sides of the stadium 20. The towers in each row are connected by arches 26 and rest on foundations 18 and, when needed, piles 16. The roof structure long-beam framing 38 is suspended by Cable-Stays 40 from the towers 22 and or their arches 26. This structure is further supported by back-stays 42 to ground anchors 28. Between the long-beam roof framing 38 is intermediate roof framing 48. Over the roof structure 38 and 48 is a roof covering or membrane 50 (see FIGS. 13 and 15) made of glass or of clear plastic or any other material and in desired areas the roof cover is made partially retractable or openable for ventilation and with louvered vents where needed and with permanently open parts where needed.

Having identified the main elements of the Cable-Stay roof structure, the preferred method of assembling this structure over an existing or new stadium or arena will be described in detail.

Starting with the stadium 20 in FIGS. 2 and 3, foundations 18, and piles 16 if needed are constructed exterior to the stadium 20. Over these foundations are constructed concrete or steel towers 22 with the use of tower cranes 24. The preferred embodiment has these towers as shown constructed from slip formed concrete in two parallel rows on opposite sides of the stadium. As an alternate they may be constructed in two curved planes on opposite sides of the stadium to more nearly fit to the shape of the stadium or they may be set in a circle, an ellipse, or other curved shape around the stadium or other structure. The preferred embodiment would have these tower rows at one point tangent to the stadium but they need not necessarily be tangent and can be set off from the stadium. The towers 22 are then connected at their top by arches 26 to one another for strength. The form of the connection need not necessarily take the form of an arch and could be a lintel, a truss, an angular brace, or any other form of reinforcement; and futhermore this entire connection can also be entirely left out such that the remaining structure of towers resemble simply rows of singular standing towers unconnected at their tops or free standing. Furthermore the towers need not necessarily be vertical, but could be tilted outward or even inward to the stadium for structural or architectural reasons. The slip forms as illustrated in FIG. 2 are designated by the numerals **29*a* and 29*b* and are shown as being filled with concrete by buckets 31 carried by the cranes 24**.

Once the towers 22 are constructed the roof construction can begin. Although the illustrated embodiment shows roof construction commencing after both rows of towers have been completed, construction can begin after one row of towers is constructed on one side to the roof out to the cantileverd end for installation by the derrick crane 32. (See FIGS. 3, 4 and 6.)

Futhermore a safety net is now installed to extend under all cantilever construction.

The roof construction now proceeds in similar fashion as by the initial framing member installation described above, but with the additional use now of the derrick crane 32 and the transport carriage 44. The procedure which repeats itself until one cantilevered section is built out to the middle of the stadium is as follows. Referring to FIG. 4, the ground crane 30 hoists roof framing members 38 and 48 from location 36 onto the roof between the towers and under the arches. The material is then loaded onto the temporary rail mounted transport carriage and carried out to the cantilevered end where it is installed by the derrick crane 32 onto the cantilevered end of the next preceding framing members. The Cable-Stays 40 and back-stays 42 are then installed as described above by top crane 34. In this manner the roof is successively built out over the stadium. Alternate sections which might be 90 feet in width are built first so that the constructed unit hangs evenly. A completed cantilevered section, one half the span of the stadium, may be 425' in length. After the alternate sections are so constructed, FIG. 8, the derrick crane is mounted in the open sections between the alternate sections, and intermediate the framing 48 installed in these intermediate sections to finish the roof, FIG. 9. In each case after a roof section is constructed the temporary rail mounted transport carriage and the derrick crane is driven back to the edge of the roof at the towers and removed from the roof by the ground crane 30 to be reinstalled in the next section to be constructed.

The roof is constructed as above from two sides of the stadium and joined in the middle. It is built either from both sides simultaneously or one side at a time.

The next step is the joining in the middle of the long-beams provided by the framing members 38. This is done in such a manner to allow for future movement of the long-beams due to temperature changes and other causes. The connecting structure is shown in FIG. 16 and comprises a slip joint provided by a sleeve 49 between the opposed cantilevered long beams and a tension cable 51 secured between the beams. A turnbuckle 53 provides for select adjustment of the tension on cable 51 and control of the long-beam force exerted on the tower legs at the edge of the roof.

Now hold-down and sidesway cables 56 are installed as needed between the roof edge and the ground or stadium structure. From FIG. 1 it will be seen that the long beams 38 and the resultant roof sections slope upwards from the towers to the point where they join and that the roof also slopes laterally from the center peak designated 47. The outermost beams 38 to which the cables 58 are joined are essentially horizontal.

After the entire roof framing is installed, checked, and adjusted, and painted, the roof covering 50 and the retractable or openable roof elements and louvered sections are installed. This is accomplished either by hoisting the materials of the roof cover onto the roof edge by the ground crane 30 and then moving them into place; or by lowering the materials onto the roof by helicopter. The retractable or openable sections are also lifted into place in the same manner and installed.

The roof is made retractable by allowing any number of roof sections, either contiguous or spaced, to slide over other roof sections and to be controlled either manually or by remote means. Such sections are designated **50*a* in FIG. 13. The remote control opening mechanism may be a hydraulic ram system to open and close the roof or it may be a mechanical cable controlled system. Retractability or ventilation opening may also be achieved by a hinged door type opening also remotely controlled. Such openings may be seen in FIGS. 14 and 15 wherein bubble panels 78 are hinged at one edge to framing 48 and may be selectively engaged or raised from engagement with adjacent framing by hydraulic cylinders 79. The roof cover 50** may also be made with louvers to allow for ventilation and, if desired, portions of the roof cover may be made permanently open in certain areas.

The roof as so constructed overlaps the stadium rim in such a manner that no rain and only minor amounts of wind can enter, but ventilation can occur. (See FIG. 9.) The roof is left unconnected to the stadium to allow for independent structural movement. The roof overlaps the rim of the stadium to provide also some protection to the concourse and other areas around the stadium.

The space between the roof and the stadium rim is made of sufficient size, possibly 10', to allow for desired ventilation. The roof, however, may be connected at this point to the stadium if so desired and the space may be closed. The closure may be a flexible gasket. See 72 FIG. 10.

Stadium stanchion lighting 73 (see FIG. 1) where existing is left in place or, where interference with the roof tower assembly 22 and 26 occurs, remounted on the roof tower assembly. These lights can then project through the completed clear skylight roof illuminating the stadium interior. Additional lighting if necessary can be installed on the underside of the roof structure.

Additional details of construction include: roof drainage and downspouts (not illustrated); roof condensation gutters on the underside of the roof (not illustrated); high pressure water cleaning jets 62 on the roof for cleaning; elevators 80 installed in the towers for access to the top of the towers and the roof; walkways and handrails formed on the tower tops and on the roof beams 38 for maintenance and sightseeing; a restaurant 60 constructed on the roof (see FIGS. 9 and 10); and luxury boxes 58 for private seating built on the roof or suspended from the roof.

It is to be understood that while the subject invention has been described with reference to a preferred method of assembly, other variations could be made by one skilled in the art without varying from the scope and the spirit of the subject invention as defined by the appended claims.

I claim:

1. A methoid of contructing a roof over an existing stadium, said method comprising:

(a) erecting a first row of cable stay towers outside one side of the stadium;

(b) erecting a second row of cable stay towers outside the side of the stadium opposite said one side;

(c) cantilevering roof structure in compression imparting relationship from each row of said towers by progressively extending sections of said structure from said towers and over the stadium while suspending each successive section by a cable stay connection to the tower from which the section extends; and, (d) joining the roof structures cantilevered from the rows of towers in tension to partially relieve compressive forces of the structures on the towers and limit such forces.

2. A method according to claim 1 further comprising extending cable-stays form the towers to anchors located outside of the stadium.

3. A method according to claim 1 wherein the structures are joined by a slip connection to permit the structures to move toward one another.

4. A method according to claim 1 wherein the towers in each row are joined by arches.

5. A method according to claim 1 further comprising extending lateral ties from the roof structures to anchors disposed outside of the stadium.

6. A method according to claim 1 further comprising extending a flexible weather seal from the roof structures to the stadium.

7. A method according to claim 1 wherein the sections of the roof structure are extended by first progressively extending long beam framing from the towers in generally parallel relationship to one another, then joining adjacent long beam framing by intermediate roof framing, and then securing a roof membrane between the long beam framing.

8. A method according to claim 7 further comprising providing means to open at least certain parts of the roof membrane.

9. A method according to claim 7 wherein the roof membrane is transparent.

10. A roof structure for use over an open topped stadium, said structure comprising:

(a) a first row of cable stay towers located outside one side of the stadium;

(b) a second row of cable stay towers located outside the stadium to the side thereof opposite said one side;

(c) a first roof section cantilevered from the first row of towers and extending therefrom partially over the stadium and toward the second row of towers, said section being disposed in compression imparting relationship to the first row of towers;

(d) a second roof section cantilevered from the second row of towers and extending therefrom partially over the stadium and toward the first row of towers, said section being disposed in compression imparting relationship to the second row of towers;

(e) first cable stay means extending from each row of said towers to suspend the load of the roof section cantilevered therefrom;

(f) second cable stay means extending from each row of said towers to counterbalance the load imparted to the towers by the first cable stay means; and, (g) connecting means securing said roof sections together in tension to partially relieve compressive forces imparted to the towers by said sections and limit such forces.

11. A structure according to claim 10 wherein said connecting means permit said roof sections to move toward one another without imparting destructive compressive forces to the towers.

12. A structure according to claim 11 wherein said connecting means further comprises a tie securing said roof sections against separation.

13. A structure according to claim 10 further comprising hold down means extending laterally from said roof sections to anchors disposed outside the stadium.

14. A structure according to claim 10 wherein said roof sections comprise:

(a) long beams extending from the towers and over the stadium in generally parallel relationship to one another;

(b) intermediate roof framing members secured to and extending between adjacent long beams; and, (c) a roof membrane at least partially closing the space between the long beams.

15. A structure according to claim 14 wherein said roof membrane comprises transparent panels, at least certain of which may be opened for ventilation.

16. A structure according to claim 15 wherein said certain panels extend between adjacent pairs of intermediate roof framing members and are hinged to one intermediate roof framing member of each pair and elevatable relative to the other member of the pair.

17. A structure according to claim 10 wherein said roof sections slope upwardly from the towers and are connected at a peak disposed over the stadium.

18. A structure according to claim 17 wherein the roof sections slope downwardly from the peak laterally from a point disposed generally centrally of the connected roof sections.

19. A structure according to claim 10 wherein the roof sections are disposed in spaced relationship to the periphery of the stadium whereby no load forces are imparted to the stadium by the structure.

20. A structure according to claim 19 further comprising a resilient seal disposed between the roof sections and the periphery of the stadium.

21. A structure according to claim 10 further comprising arches joining the towers in each row of towers.

22. A structure according to claim 10 further comprising sightseeing and maintenance walkways on the roof framing members.

23. A method of constructing a roof over an existing stadium, said method comprising:

(a) erecting a first row of cable stay towers outside one side of the stadium;

(b) erecting a second row of cable stay towers outside the side of the stadium opposite said one side;

(c) cantilevering roof structure from each row of said towers by progressively extending sections of said structure from said towers and over the stadium while suspending each successive section by a cable stay connection to the tower from which the section extends by the following steps:

(i) preconstructing and disposing the roof sections at staging areas located at the foot of the towers;

(ii) lifting the sections onto the towers by ground located cranes;

(iii) initially suspending the sections in cantilevered relationship to the towers by tower located cranes; and, (iv) successively placing the sections in cantilevered relationship by traveling derrick cranes movable long the roof structure;

(d) joining the roof structures cantilevered from the rows of towers to provide a cover over the stadium.

24. A roof structure for use over a pre-existing open topped stadium, said structure comprising:

(a) a first row of cable stay towers located outside one side of the stadium;

(b) a second row of cable stay towers located outside the stadium to the side thereof opposite said one side;

(c) a first roof section cantilevered from the first row of towers and extending therefrom partially over the stadium and toward the second row of towers, said section being disposed in compression imparting relationship to the first row of towers;

(d) a second roof section cantilevered from the second row of towers and extending therefrom partially over the stadium and toward the first row of towers, said section being disposed in compression imparting relationship to the second row of towers;

(e) first cable stay means extending from each row of said towers to suspend the load of the roof section cantilevered therefrom;

(f) second cable stay means extending from each row of said towers to counterbalance the load imparted to the towers by the first cable stay means;

(g) connecting means securing said roof sections together; and, (h) occupant carrying compartments supported on the roof sections.

25. A roof structure for use over a pre-existing open topped stadium, said structure comprising:

(a) a first row of cable stay towers located outside one side of the stadium;

(b) a second row of cable stay towers located outside the stadium to the side thereof opposite said one side;

(c) a first roof section cantilevered from the first row of towers and extending therefrom partially over the stadium and toward the second row of towers, said section being disposed in compression imparting relationship to the first row of towers;

(d) a second roof section cantilevered from the second row of towers and extending therefrom partially over the stadium and toward the first row of towers, said section being disposed in compression imparting relationship to the second row of towers;

(e) first cable stay means extending from each row of said towers to suspend the load of the roof section cantilevered therefrom;

(f) second cable stay means extending from each row of said towers to counterbalance the load imparted to the towers by the first cable stay means;

(g) connecting means securing said roof sections together; and, (h) water jets carried by and above the roof secitons for dispensing water over the sections.

26. A roof structure for use over a pre-existing open topped stadium, said structure comprising:

(a) a first row of cable stay towers located outside one side of the stadium;

(b) a second row of cable stay towers located outside the stadium to the side thereof opposite said one side;

(c) a first roof section cantilevered from the first row of towers and extending therefrom partially over the stadium and toward the second row of towers, said section being disposed in compression imparting relationship to the first row of towers;

(d) a second roof section cantilevered from the second row of towers and extending therefrom partially over the stadium and toward the first row of towers, said section being disposed in compression imparting relationship to the second row of towers;

(e) first cable stay means extending from each row of said towers to suspend the load of the roof section cantilevered therefrom;

(f) second cable stay means extending from each row of said towers to counterbalance the load imparted to the towers by the first cable stay means;

(g) connecting means securing said roof sections together; and, (h) elevators in the towers for roof and tower access.

* * * * *